United States Patent [19]

Wilson et al.

[11] Patent Number: 5,058,400

[45] Date of Patent: Oct. 22, 1991

[54] INTARSIA CARRIAGE INCORPORATING ROW COUNTER

[76] Inventors: Trevor E. Wilson; Joan A. M. Wilson, both of Bargate, Parsonage Hill, Somerton Somerset, England, TA11 7PF

[21] Appl. No.: 481,984

[22] Filed: Feb. 14, 1990

[30] Foreign Application Priority Data

Feb. 21, 1989 [GB] United Kingdom ..... 8903850
Dec. 6, 1989 [GB] United Kingdom ..... 8927543

[51] Int. Cl.[5] ..... D04B 37/00
[52] U.S. Cl. ..... 66/60 H
[58] Field of Search ..... 66/60 R, 60 H

[56] References Cited

U.S. PATENT DOCUMENTS 4,674,300 6/1987 Thompson, Jr. ..... 66/8

FOREIGN PATENT DOCUMENTS 62-69860 3/1987 Japan ..... 66/60 R
907671 10/1962 United Kingdom ..... 66/60 H
1266614 10/1962 United Kingdom .

*Primary Examiner*—Werner H. Schroeder
*Assistant Examiner*—John J. Calvert
*Attorney, Agent, or Firm*—Silverman, Cass & Singer, Ltd.

[57] ABSTRACT

An Intarsia carriage for a knitting machine incorporates an integral row counter operable by a spring plunger on the counter engaging a cam on the bed of the knitting machine. The counter has three drums 20, 21 and 22 controlled by ratchets, the drums having internal teeth. Each drum 20, 21 and 22 is carried on a hollow sleeve 29 supported on a segment 30 engaged on a main shaft 17. Three staggered spring click levers 34, 35 and 36 engage internal teeth 27 in the drums and each drum has an internal recess which allows the click lever to move outwardly for one tooth only after nine clicks this causes the adjacent click lever to move its drum one click.

10 Claims, 3 Drawing Sheets

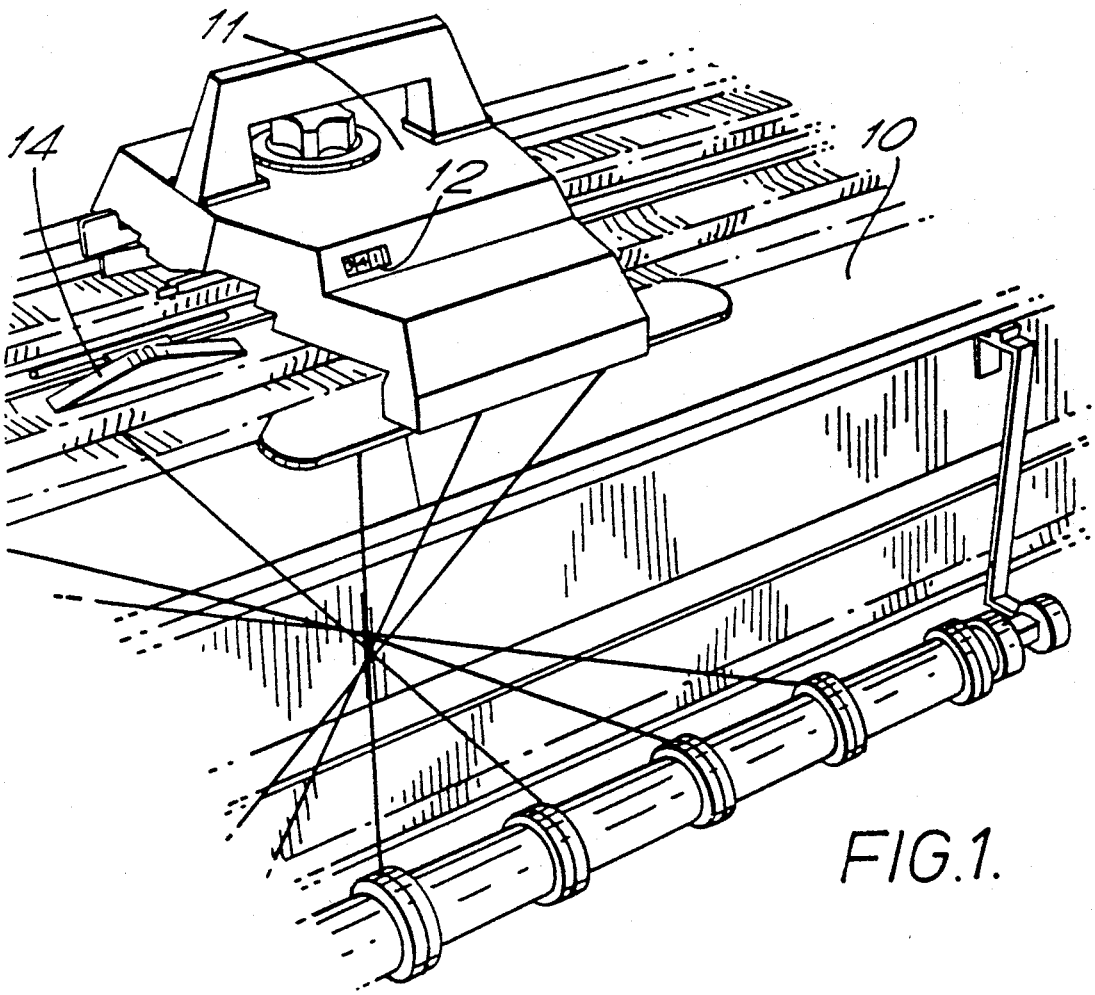
FIG. 1.
FIG. 2.
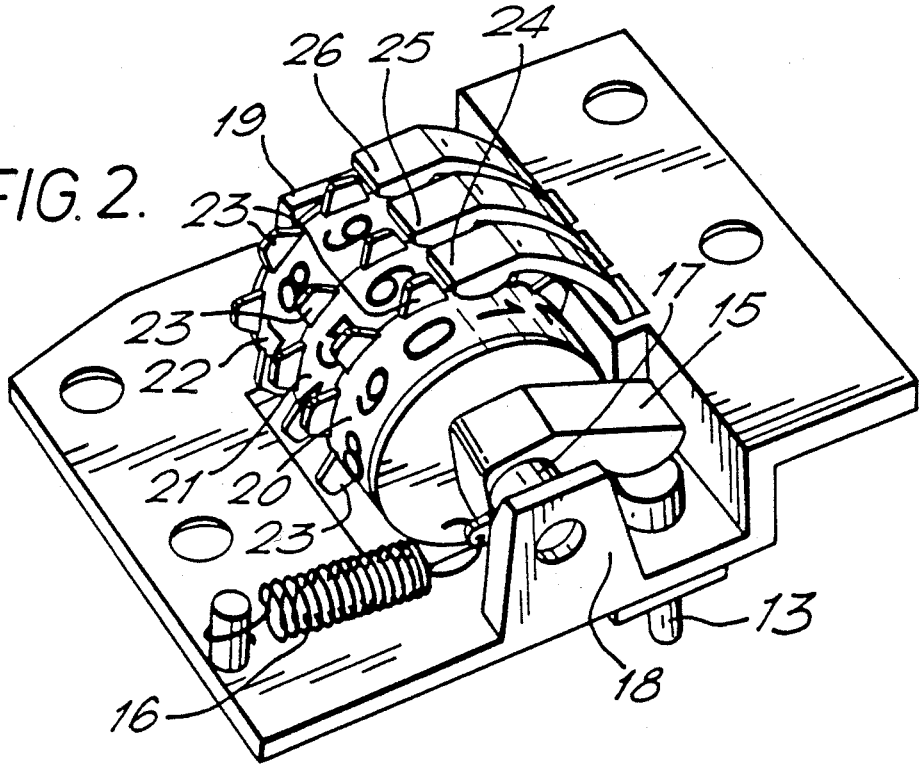

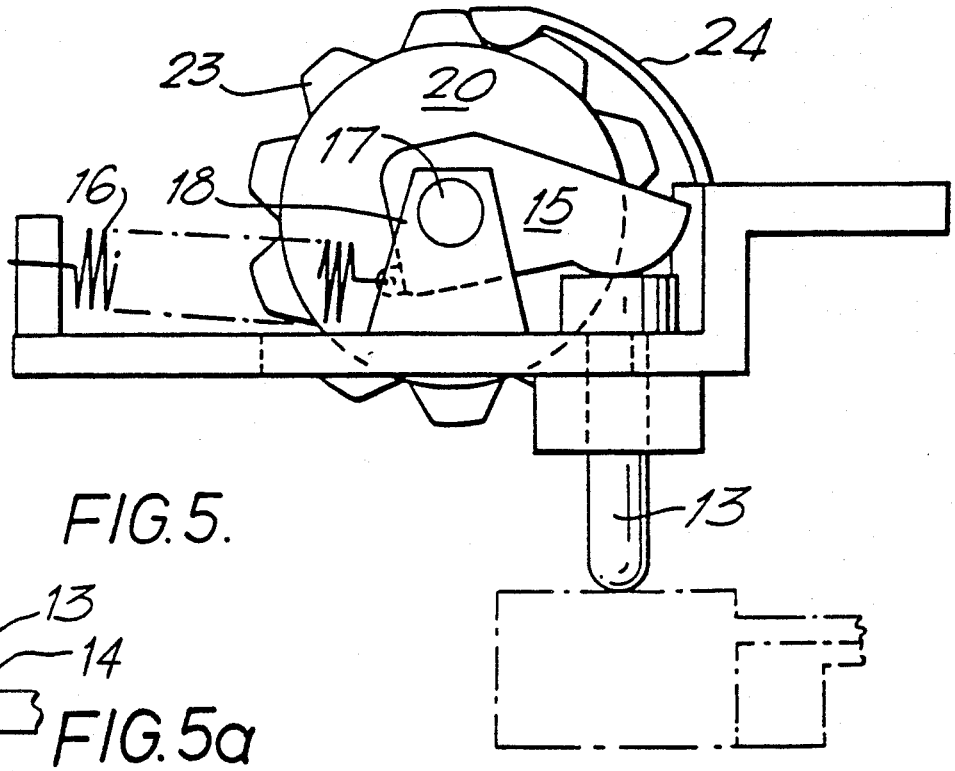
FIG. 5.
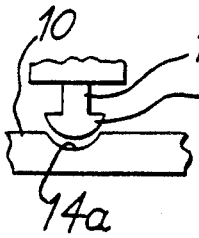
FIG. 5a
FIG. 6.
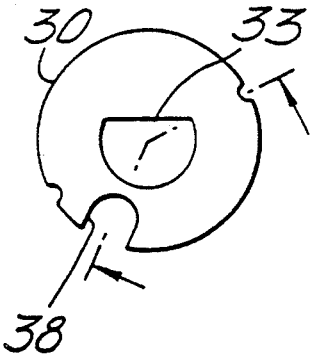
FIG. 7.
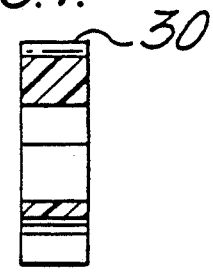
FIG. 10.
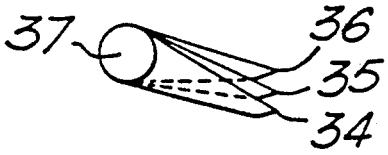
FIG. 8.
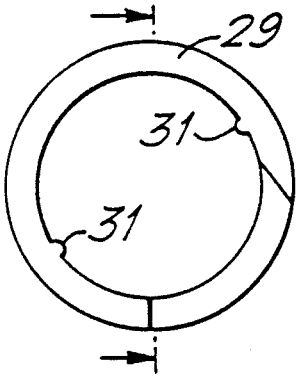
FIG. 9.
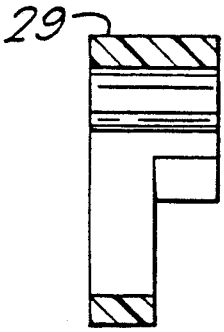
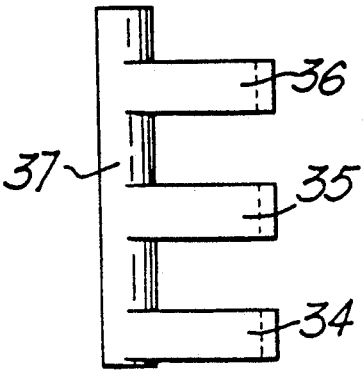
FIG. 11.

INTARSIA CARRIAGE INCORPORATING ROW COUNTER

This invention relates to an Intarsia carriage for a knitting machine.

An Intarsia carriage is a unit adapted to be slidably mounted on a knitting machine bed and so designed that, when the carriage is moved longitudinally over the needle bed, it will place the needles in a forward position with the needle hooks protruding beyond the sinker post. This enables the yarn to be laid over the needle hooks feeding from the front of the machine and not from the back as is usual when knitting automatically with the main carriage.

Most knitting machines incorporate some form of row counter but when an Intarsia carriage is added to a knitting machine, in some instances, it is not possible to employ the Intarsia carriage to operate the row counter on the existing knitting machine.

In accordance with the present invention an Intarsia carriage is provided with an integral row counter. Preferably the row counter is adapted to be operated by a cam mounted on a knitting machine bed. The counter itself preferably comprises a plurality of drums mounted to rotate on a shaft and moveable by internal click levers, the tip of each click lever being marginally further radially outward than its adjoining click lever, in sequence from one end of a secondary shaft on which the click levers are mounted.

The secondary shaft is preferably supported at a number of points along its length by being engaged in a hole at the peripheries of circular segments carried within a hollow sleeve on which each drum rotates. The circular segments preferably each have an eccentrically shaped bore, such as a 'D'-shaped bore adapted to fit over a main shaft supporting the assembly.

The drums may have internal ratchet teeth, one of the teeth on each drum being deeper than the others and being adapted to receive one of the click levers and thus to allow that click lever to move radially further out so that the adjacent click lever can move to a position in which it can engage a tooth of the next adjacent drum.

From another aspect, there is an Intarsia carriage incorporating an integral row counter and mounted on the bed of a knitting machine so that as the Intarsia carriage is moved across the bed of the machine, a cam located on the bed operates a sprung mechanism on the counter to cause the counter to register a row.

The cam may be carried on a peg which engages a recess in the machine bed.

In the accompanying drawings:

FIG. 1 is a perspective view of part of the bed of a knitting machine on which is mounted an Intarsia carriage incorporating an integral row counter in accordance with the present invention;

FIG. 2 shows the row counter per se, removed from the Intarsia carriage;

FIG. 5 is an end elevation of the row counter as mounted within the Intarsia carriage showing how the counter is operated by contact of a spring plunger with a cam on the bed of the machine;

Figure 3:
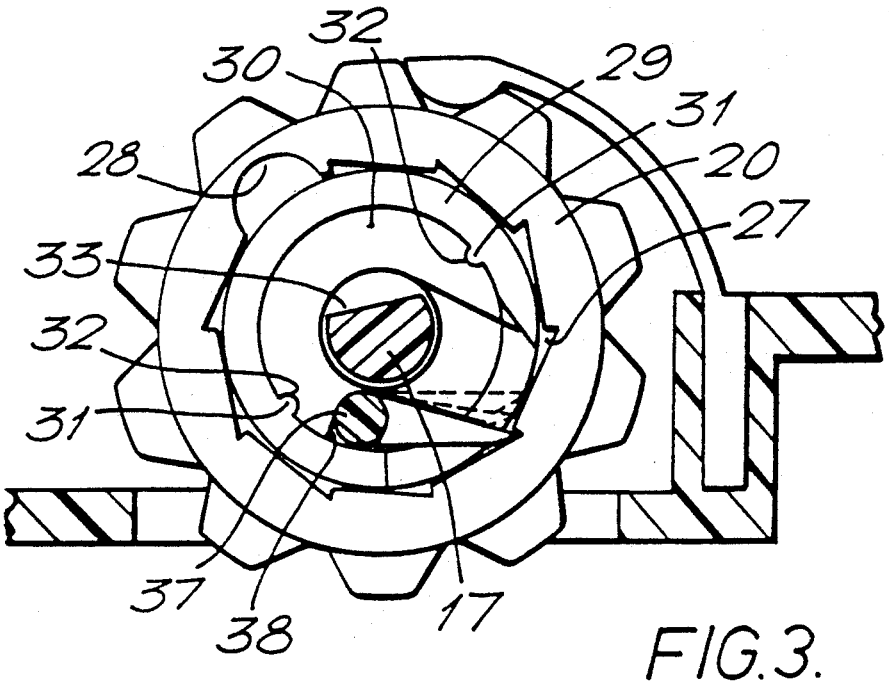
FIG. 3 is a section through the row counter showing the internal construction.

FIG. 5*a* is a cross-sectional view in partial section of an alternate embodiment of the peg and cam assembly of the invention;

FIG. 6 is an elevation of a circular segment employed in the counter;

FIG. 7 is a section through the segment;

FIG. 8 is an elevation of a circular sleeve adapted to contain segments shown in FIG. 6;

FIG. 9 is a section through the circular sleeve; and

FIG. 10 is an elevation and FIG. 11 a plan of a set of three click levers carried on a secondary shaft.

The portion of the knitting machine bed 10 has mounted on it an Intarsia carriage 11 and the Intarsia carriage 11 incorporates a counter 12 of the type shown in FIG. 2. The counter is operated as the Intarsia carriage moves across the bed 10 by contact between the spring pressed plunger 13 (FIG. 2) and a cam 14.

The plunger 13 moves a lever 15 against pressure of the spring 16 so as to cause movement of the counter.

The lever 15 is carried on a shaft 17 supported at its ends in trunions 18 and 19.

The counter consists of three drums 20, 21 and 22 each having numbers 0 to 9 and each of which has a series of ratchet teeth such as 23 engageable by respective spring ratchet arms 24, 25 and 26 so that a single movement of plunger 13 will result in the first drum 20 moving round one click as the ratchet 24 rides over the teeth 23, which are set, in this instance, at 36° pitch. Ratchet arms 24, 25 and 26 are so shaped as to engage with the teeth to restrain the drums in each number position 0 to 9.

Figure 4:
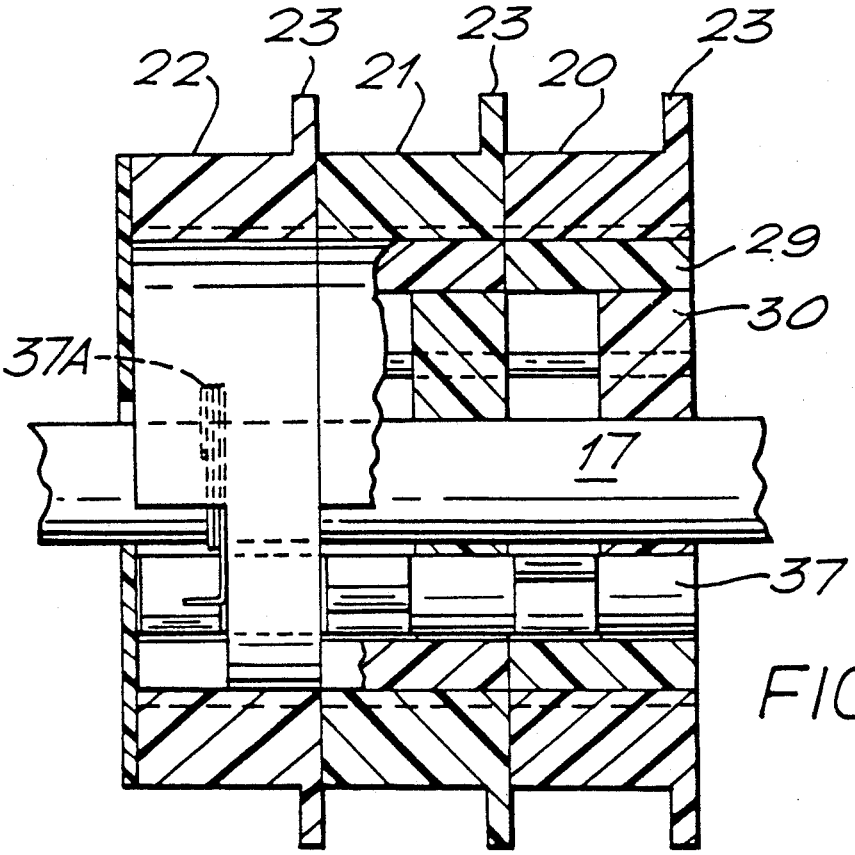
FIG. 4 is a plan, largely in section, with parts broken away to show the internal arrangement of the parts of the row counter more clearly.

The mechanism within the drums will now be described in detail. Referring now to FIGS. 3 and 4 and also at various times to FIGS. 5 to 11, it will be seen, from FIG. 3, that drum 20 is provided with internal ratchet teeth 27 round most of its entire periphery and an enlarged tooth or recess 28 at one point on its periphery.

The drum 20 is carried by a hollow sleeve 29 in turn supported on a segment 30. The segment fits within the sleeve and is located there by pips 31 engageable in recesses 32. The segment 30 has a 'D'-shaped hole 33 which engages over the main shaft 17.

The precise shape of the segments and sleeves can be seen respectively in FIGS. 6 and 7 and FIGS. 8 and 9. The portion of the sleeve 29 not occupied by the segment 30 has a gap in its circumference of 40°—see FIG. 9.

An important feature of this invention is the use of three click levers, 34, 35 and 36 mounted on a secondary shaft 37. The shaft 37 is supported in recesses 38 in each of the three segments 30 and the click levers extend through gaps in the segments and corresponding gaps in the sleeves 29 so as to engage the teeth 27 of the drums 20. The click levers are biased by a spring 37A (FIG. 4).

As can be seen in FIG. 10, the three click levers are staggered in height. Initially the click lever of drum 20 will engage the teeth of drum 20 and will move that drum round one tooth at a time as the counter is operated. When the click lever tip reaches the enlarged recess 28, it will enter that recess and thus allow the adjacent click lever to begin to engage in the internal teeth of the next drum thus moving it round one notch. This will clearly only happen every tenth click of the first drum. A similar effect occurs when the click lever in the second drum reaches its recess. It will allow the third click lever to engage an internal tooth of the appropriate drum and move that round one notch.

In assembly, the secondary shaft 37 is slotted into each recess 38 in each segment 30 and the secondary shaft 37 is then enclosed in the recesses 38 by sliding the hollow sleeves 29 over the respective segments 30 in keyed positions. The three drums 20, 21 and 22 are then placed on and over the completed segment 30 and sleeve units. The whole assembly is then slid onto the main shaft 17. Thus the series of segments and hollow sleeve units become a bearing shaft for the drums.

The click levers on the secondary shaft are then in position to be able to penetrate the recesses in each hollow sleeve circumference in order to contact the ratchet teeth when impelled by spring 37A. Lever 15, with non-circular hole, is then keyed onto the end of the main shaft 17.

With the first secondary shaft click lever in engagement with said ratchet teeth, because of the aforementioned fractional difference in height of the adjoining click levers, the first click lever holds the adjoining click levers out of engagement with the ratchet teeth in adjoining drums. Thus the first drum will, as a result of the lever movement, rotate the first drum the required 36°, while the 2nd and 3rd drums remain stationary. This situation persists until the first drum has rotated 360° and the first click lever is impelled by a spring into the deeper ratchet tooth or recess.

This increased movement of the first click lever allows the second and adjoining click lever to engage the said ratchet teeth on the inner surface of the second drum. Thus the second drum will rotate 36° to each complete 360° rotation of the first drum. This process continues with the third and additional drums.

To summarise the operation, the first drum, when rotated in a series of steps of 36°, shows Figures 0 to 9 for each step in the appropriate viewing window. When 9 shows in the window the first click lever is then in the deeper ratchet tooth or recess so the click lever in drum two, on the next movement of drum one, will itself rotate drum two 36°. As it does so the click lever in drum one returns to the higher level of ratchet teeth, taking the click lever out of engagement in drum two. This action will continue until drum one has rotated once again to 9 showing in the viewing window. When 9 shows in drum two the above process causes drum three to rotate 36° with any 360° rotation of drum two.

FIG. 5*a* illustrates an alternate embodiment of the invention where common elements are referred to by the same reference numerals. In this embodiment, the peg 13 includes the cam 14 and the bed 10 includes a cam recess 14*a*. Accordingly, when the intarsia carriage 11 is moved across the bed 10, the cam extends into the cam recess 14*a* to activate the counter 12 through the cam 14 and peg 13.

We claim:

1. An intarsia carriage for a knitting machine comprising a row counter integral with said carriage, said row counter including a plurality of drums mounted to rotate on a shaft and moveable by internal click levers, the tip of each click lever being marginally further radially outward than its adjoining click lever in sequence from one end of a secondary shaft on which the click levers are mounted.

2. A carriage according to claim 1 and in which the secondary shaft is supported at a number of points along its length by being engaged in a hole at the periphery of a circular segment carried within a hollow sleeve on which each drum rotates.

3. A carriage according to claim 2 in which the drums each have internal ratchet teeth, one of the teeth on each drum being deeper than the others and being adapted to receive one of the click levers and thus to allow that click lever to move radially further out so that the adjacent click lever can move to a position in which it can engage a tooth of the next adjacent drum.

4. A carriage according to claim 2 and in which the circular segments each have an eccentrically shaped hole which substantially is a 'D'-shaped hole fitted over a main shaft supporting the assembly.

5. A carriage according to claim 4 in which the drums each have internal ratchet teeth, one of the teeth on each drum being deeper than the others and being adapted to receive one of the click levers and thus to allow that click lever to move radially further out so that the adjacent click lever can move to a position in which it can engage a tooth of the next adjacent drum.

6. A carriage according to claim 1 and in which the drums each have internal ratchet teeth, one of the teeth on each drum being deeper than the others and being adapted to receive one of the click levers and thus to allow that click lever to move radially further out so that the adjacent click lever can move to a position in which it can engage a tooth of the next adjacent drum.

7. An intarsia carriage for a knitting machine comprising a row counter integral with said carriage and operated by a cam member mounted on a bed of the knitting machine, said row counter including a plurality of drums mounted to rotate on a shaft and moveable by internal click levers, the tip of each click lever being marginally further radially outward than its adjoining click lever in sequence from one end of a secondary shaft on which the click levers are mounted.

8. An intarsia carriage for mounting on a bed of a knitting machine comprising:

a row counter member integral with the intarsia carriage;

a cam member; and a peg connecting said cam member to said row counter member, said peg capable of operating a mechanism within said row counter member to cause said row counter member to register a row so that upon engagement of said cam member with a recess formed in the bed of the knitting machine said peg operates said mechanism to register a row.

9. A knitting assembly comprising:

a knitting machine including a substantially flat elongate machine bed;

an intarsia carriage;

means for mounting said intarsia carriage to said elongate bed for sliding longitudinal movement along said elongate bed;

an outwardly extending cam member positioned on said elongate bed of said knitting machine; and row counter means integral with said intarsia carriage for engagement with said cam member during sliding movement of said carriage along said bed of said knitting machine, said row counter means capable of registering a row upon engagement with said cam member.

10. A knitting assembly comprising:

a knitting machine including a substantially flat elongate machine bed;

an intarsia carriage;

means for mounting said intarsia carriage to said elongate bed for sliding longitudinal movement along said elongate bed;

an outwardly extending engagement member positioned on said elongate bed of said knitting machine; and row counter means integral with said intarsia carriage for engagement with said engagement member during sliding movement of said carriage along said bed of said knitting machine, said row counter means capable of registering a row upon engagement with said engagement member.

* * * * *